United States Patent [19]

Takahashi et al.

[11] Patent Number: 4,655,261

[45] Date of Patent: Apr. 7, 1987

[54] YARN CUTTING SCISSORS DEVICE

[75] Inventors: Kouji Takahashi, Tokyo; Rikio Takahashi, Yokohama, both of Japan

[73] Assignee: Takahashi Seimitsu Kogyo Kabushiki Kaisha, Japan

[21] Appl. No.: 797,582

[22] Filed: Nov. 13, 1985

[30] Foreign Application Priority Data

Aug. 17, 1985 [JP] Japan ..... 60-125494[U]

[51] Int. Cl.[4] ..... D03D 49/70; D05B 65/00

[52] U.S. Cl. ..... 139/302; 112/294; 112/297

[58] Field of Search ..... 139/302, 303, 450, 429; 112/294, 297; 66/134, 145 R

[56] References Cited

U.S. PATENT DOCUMENTS

| | | | |
|---|---|---|---|
| 4,031,925 | 6/1977 | Santucci | 139/429 |
| 4,134,434 | 1/1979 | Malasek et al. | 139/302 X |
| 4,143,684 | 3/1979 | Lindenmuller et al. | 139/302 X |
| 4,470,435 | 9/1984 | Lucian et al. | 139/309 X |

FOREIGN PATENT DOCUMENTS

| | | | |
|---|---|---|---|
| 145583 | 9/1984 | Japan | 139/302 |

*Primary Examiner*—H. Hampton Hunter

*Attorney, Agent, or Firm*—Blum Kaplan Friedman Silberman & Beran

[57] ABSTRACT

A yarn cutting scissors device suitable for use for cutting a weft is disclosed which is capable of decreasing the frictional force occurring between a stationary blade and a movable blade when both blades are successively engaged in the cutting operation and effectively accomplishing the accessible engagement between both blades. The yarn cutting scissors device includes a leaf spring which has one end fixedly mounted on a support block and the other end on which a stationary blade is mounted, a shim washer arranged between the support block and the leaf spring, and a compression coil spring mounted on the support block to constantly urge a movable blade against the stationary blade, so that the stationary blade may be oscillated in the direction perpendicular to that of oscillation of the movable blade.

8 Claims, 2 Drawing Figures

YARN CUTTING SCISSORS DEVICE

BACKGROUND OF THE INVENTION

1. Field of the Invention

This invention relates to a yarn cutting scissors device, and more particularly to a yarn cutting scissors device suitable for cutting a weft woven at a loom.

2. Description of the Prior Art

A typical yarn cutting scissors device which has been conventionally proposed and used in the art is disclosed in Japanese Utility Model Application Laid-Open Publication No. 145,583/1984. The scissors device taught in the publication is constructed in a manner such that a stationary blade or blade plate is mounted through a leaf spring on an end surface of a bearing block or support base and a movable blade is mounted through a leaf spring on a distal end of an oscillating shaft, so that both blades may be operated relatively to each other with the oscillation of the oscillating shaft to carry out the cutting of a yarn.

However, such construction of the conventional yarn cutting scissors device as described above has an important disadvantage that biasing forces generated from both leaf springs cause a large frictional force to occur at the edge portions of both blades successively engaged with each other in the cutting operation, resulting in the blades being highly damaged and worn.

Also, another disadvantage encountered with the conventional yarn cutting scissors device is that the generation of any looseness or backlash between both blades causes a gap to be formed therebetween, to thereby substantially deteriorate the sharpness or quality of the scissors. In order to prevent the generation of such looseness, a mechanism is proposed which is constructed in a manner such that an adjusting ring spacer is fittedly mounted on a rear end of the oscillating shaft projecting from the bearing block and supported by means of an E-shaped ring fixed on the oscillating shaft. Unfortunately, such mechanism proposed fails to fully absorb the losseness because it is highly troublesome or substantially impossible to precisely adjust the thickness of the ring spacer. Thus, the conventional yarn cutting scissors device requires another adjusting means for appropriately adjusting the engagement between both blades, resulting in the structure of the conventional yarn cutting scissors device being highly complicated and the manufacturing costs being substantially increased.

Accordingly, it would be highly desirable to develop a yarn cutting scissors device which is capable of decreasing a frictional force which occurs at the edge portions of both blades successively engaged with each other and accomplishing the effective engagement between both blades.

SUMMARY OF THE INVENTION

The present invention has been made in view of the foregoing disadvantage of the prior art.

In accordance with the present invention, there is provided a yarn cutting scissors device comprising a support block; an oscillating shaft supported at the support block so as to be oscillated in the circumferential direction thereof; a stationary blade fixedly mounted on the support block; spacer means arranged between the support block and the stationary blade to define a suitable gap therebetween; oscillation means for permitting the stationary blade to be oscillated in the longitudinal direction of the oscillating shaft; a movable blade fixedly mounted on the oscillating shaft so as to be opposite to the stationary blade and arranged to carry out the accessible movement with respect to the stationary blade with the oscillation of the oscillating shaft; and bias means for constantly urging the movable blade and stationary blade against each other.

In the present invention constructed as described above, the movable blade is permitted to be constantly contacted with the stationary blade due to the urging force of the bias means. During the operation, the oscillation means allows the stationary blade to be oscillated in the longitudinal or axial direction of the oscillating shaft about the spacer means due to the movement of the contacting point between the movable blade and the stationary blade, to thereby effectively prevent the excessive frictional contact between both blades.

In a preferred embodiment of the present invention, the oscillation means comprises a leaf spring which has one end having the stationary blade mounted thereon and the other end mounted on the support block, the stationary blade being mounted on the support block through the leaf spring.

In a preferred embodiment of the present invention, the spacer means comprises a shim washer interposedly arranged between the stationary blade and the support block.

In a preferred embodiment of the present invention, the spacer means comprises a shim washer interposedly arranged between the leaf spring and the support block.

In a preferred embodiment of the present invention, the bias means comprises a spring for urging the oscillating shaft against the support block.

In a preferred embodiment of the present invention, the spring comprises a compression coil spring fitted on the oscillating shaft so as to be interposed between the oscillating shaft and the support block.

In a preferred embodiment of the present invention, the movable blade includes a blade body comprising a blade plate and a cutting edge perpendicular to the blade plate, the blade body being formed to have a small thickness.

In accordance with the present invention, there is also provided a yarn cutting scissors device comprising a support block having a horizontal through-hole; an oscillating shaft supportedly fitted in the through-hole of the support block so as to be oscillated in the circumferential direction thereof; a stationary blade fixedly mounted on a front end surface of the support block; a movable blade fixedly mounted on a front end of the oscillating shaft so as to opposite to the stationary blade and arranged to carry out the accessible movement with respect to the stationary blade with the oscillation of the oscillating shaft; a leaf spring having one end fixedly mounted on the front end surface of the support block and the other end on which the stationary blade is mounted, the stationary blade being mounted on the front end surface of the support block through the other end of the leaf spring; a spacer interposedly arranged between the front end surface of the support block and the leaf spring; and spring means mounted on a rear portion of the support block to constantly urge the oscillating shaft in the rearward direction, to thereby force the movable blade against the stationary blade.

Accordingly, it is an object of the present invention to provide a yarn cutting scissors device which is capable of significantly decreasing the frictional force between a stationary blade and a movable blade which is generated when both blades are successively engaged.

It is another object of the present invention to provide a yarn cutting scissors device which is capable of effectively accomplishing the accessive engagement between both blades.

It is a further object of the present invention to provide a yarn cutting scissors device which is capable of highly reducing the wearing of blades to substantially lengthen the life of the scissors device.

It is still another object of the present invention to provide a yarn cutting scissors device which is capable of increasing the speed of the yarn cutting operation to highly improving the operational efficiency.

It is yet another object of the present invention to provide a yarn cutting scissors device which is capable of accomplishing the above-described objects with a simple structure.

Still other objects and advantages of the invention will in part be obvious and will in part be apparent from the specification.

The invention accordingly comprises the feature of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
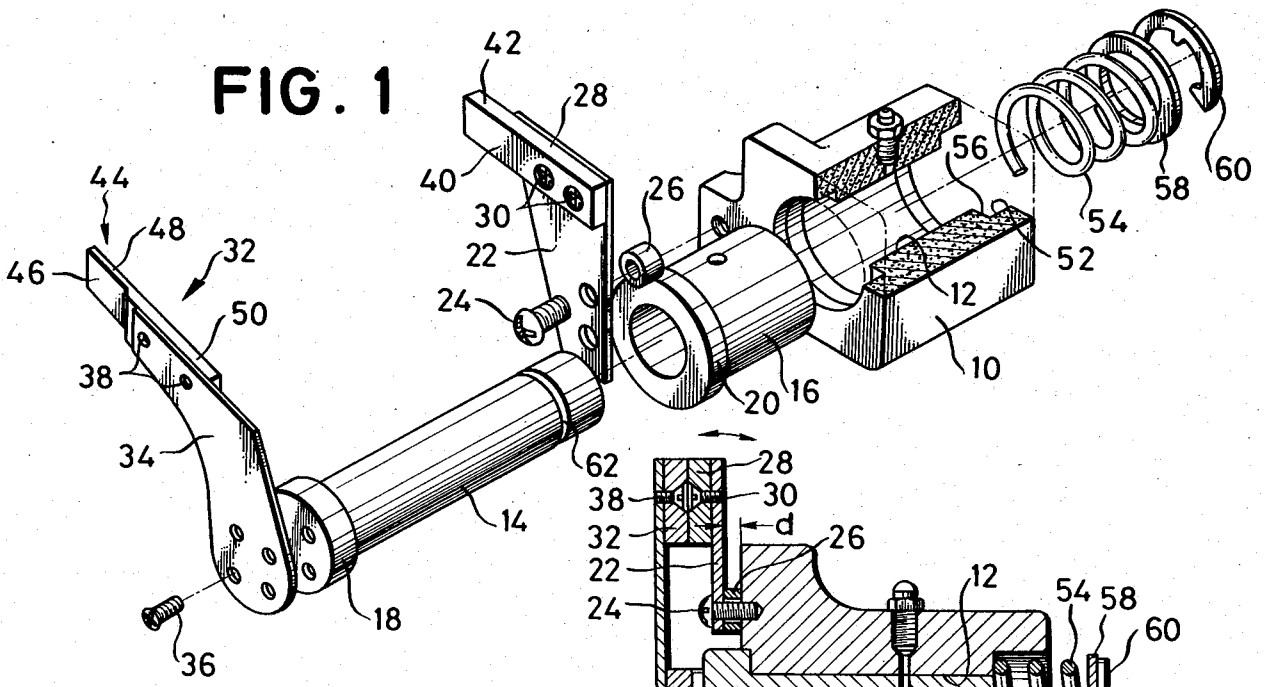
FIG. 1 is an exploded perspective view partly in section showing an embodiment of a yarn cutting scissors device according to the present invention.

Now, a yarn cutting scissors device according to the present invention will be described hereinafter with reference to the accompanying drawings in which like reference numerals designate like parts throughout.

Figure 2:
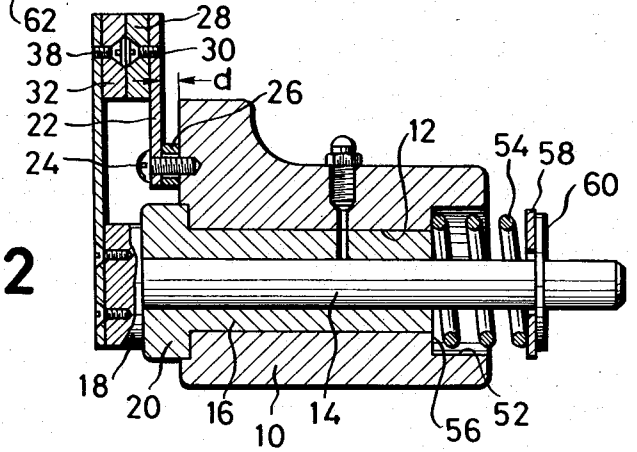
FIG. 2 is a plan view showing the assembling of the yarn cutting scissors device shown in FIG. 1.

FIGS. 1 and 2 show an embodiment of a yarn cutting scissors device according to the present invention. A yarn cutting scissors device of the illustrated embodiment includes a bearing block or support block 10 formed of a suitable material such as plastic or the like and provided with a horizontal through-hole 12 and an oscillating shaft 14 rotatably fitted or supported via the through-hole 12 and a bush 16 in the support block 10. The oscillating shaft 14 and bush 16 are provided at the distal ends thereof with flanges 18 and 20, respectively. The flanges 18 and 20 serve to prevent the oscillating shaft 14 and bush 16 from being free via the through-hole 12 from the support block 10, respectively.

The yarn cutting scissors device of the illustrated embodiment also includes a leaf spring 22 which is mounted at one end thereof on one side portion of a front end surface of the support block 10 by means of a pair of panhead screws 24. Interposed between the leaf spring 22 and the support block 10 is a shim washer 26 whch is adapted to space the leaf spring 22 from the front end surface of the bearing block or support block 10 at a predetermined distance d. The scissors device of the illustrated embodiment also includes a stationary blade 28 which is fixedly mounted at a base portion thereof on an upper end or free end of the leaf spring 22 by means of a pair of flush screws 30.

Reference numeral 32 designates a movable blade fixedly mounted through a leaf spring 34 on a distal end surface of the oscillating shaft 14 in a manner to be opposite to the stationary blade 28. More particularly, the leaf spring 34 is fixed at a base end thereof on the distal end surface of the oscillating shaft 14 by means of flush screws 36 and the movable blade 32 is fixedly mounted on a distal end or oscillating end of the leaf spring 34 by means of flush screws 38, so that the oscillating movement or fractional reciprocal movement of the oscillating shaft 14 in the peripheral or circumferential direction thereof may cause the movable blade 32 to carry out the accessible movement or approaching and separating movement of the movable blade with respect to the stationary blade 28 in the circumferential direction of the oscillating shaft 14.

The stationary blade 28 and movable blade 32 each may be formed of a ceramic material, a refractory metal material containing tungsten carbide and cobalt, or the like. In the illustrated embodiment, the stationary blade 28 comprises a blade plate 40 and a cutting edge 42 having a cutting face formed perpendicular to the blade plate 40, and the movable blade 32 includes a blade body 44 comprising a blade plate 46 and a cutting edge 48 hav1ng a cutting face formed perpendicular to the blade plate 46. The movable blade 32 is so formed that the blade body 44 has a thickness smaller than a mounting section 50 of the movable blade through which the blade 32 is mounted on the oscillating shaft 14. In general, the arrangement of both a stationary blade and a movable blade in the direction oblique rather than perpendicular with respect to the direction of feeding a weft shortens the projecting length of the weft remaining at the time of cutting. Such construction of the movable blade 32 as described above still further shortens the projecting length of such a weft to more effectively accomplish the saving of a weft.

The through-hole 12 of the support block or bearing block 10 is enlarged at the rear portion to have a larger diameter as indicated by reference numeral 52 in FIGS. 1 and 2. Received in the enlarged rear portion 52 of the through-hole 12 is an front end of a compressed coil spring 54. The coil spring 54 is abutted at the front end thereof against a step 56 between the enlarged rear portion 52 of the through-hole 12 and a front portion of the through-hole 12 having a smaller diameter and at a rear end thereof against a flat washer 58 fitted on a rear end of the oscillating shaft 14 projecting outwardly from the support block 10. The flat washer 58 is securely held on the oscillating shaft 14 by means of a substantially E-shaped ring 60 securely fitted in a peripheral groove 62 formed on the oscillating shaft 12 in proximity to the rear end thereof. Thus, the oscillating shaft 14 is constantly urged in the rearward direction by means of the compressed coil spring 54, resulting in the movable blade 32 being constantly forced against the stationary blade 28 as shown in FIG. 2.

Now, the manner of operation of the yarn cutting scissors device of the illustrated embodiment constructed as described above will be described hereinafter with reference to FIGS. 1 and 2.

First, the yarn cutting scissors device is obliquely arranged on a side of a loom. The oscillating shaft 14 is actuated in a manner to be oscillated in the circumferential direction thereof in synchronism with the actuation of the loom, so that the movable blade 32 fixedly mounted on the oscillating shaft 14 may carry out the accessible movement or approaching and separating movement with respect to the stationary blade 28 to cut a weft at a high speed. Such accessible movement of the movable blade 32 with respect to the stationary blade 28 causes the point of the cutting edge 48 of the movable blade 32 contacting with the stationary blade 28 to be reciprocally varied or moved. Such movement causes the leaf spring 22 supporting the stationary blade 28 thereon to be oscillated in the longitudinal direction of the oscillating shaft 14 about the shim washer 26 as indicated at arrows in FIG. 2. Such oscillation of the leaf spring 22 effectively prevents the frictional contact between the movable blade 32 and the stationary blade 28 from being excessively occurring due to the compression force of the coil spring 54 during the movement.

As can be seen from the foregoing, the yarn cutting scissors device of the present invention is so constructed that the leaf spring for the stationary blade is oscillated in the axial direction of the oscillating shaft about the shim washer with the movement of the point of the movable blade contacting with the stationary blade. Such construction prevents the excessive frictional contact between the movable blade and the stationary blade while providing the scissors device of the present invention with satisfied sharpness. Also, in the yarn cutting scissors device of the present invention, the oscillating shaft is constantly urged in the rearward direction by means of the spring means arranged at the rear side of the support block, so that the present invention may not require a troublesome structure for preventing the looseness in the axial direction of the oscillating shaft and additional means for adjusting the frictional force between the movable blade and the stationary blade.

Thus, the present invention is capable of significantly reducing the wearing of the blades due to friction to lengthen the life of the scissors device. Also, the present invention is capable of not only highly accomplishing the yarn cutting operation with a high speed but simplifying the structure of the scissors device.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A yarn cutting scissors device comprising:

a support block;

an oscillating shaft supported at said support block so as to be oscillated in the circumferential direction thereof;

a stationary blade coupled to said support block;

spacer means arranged between said support block and said stationary blade to define a suitable gap therebetween;

oscillation means coupled between the stationary blade and spacer means for causing said stationary blade to be oscillated in said gap about said spacer means in the longitudinal direction of said oscillating shaft;

a movable blade fixedly mounted on said oscillating shaft so as to be opposite to said stationary blade and arranged to carry out the accessible movement with respect to said stationary blade with the oscillation of said oscillating shaft; and bias means for urging said oscillating shaft against said support block to urge said movable blade against said stationary blade.

2. A yarn cutting scissors device as defined in claim 1, wherein said oscillation means comprises a leaf spring which has one end having said stationary blade mounted thereon and the other end mounted on said support block, said stationary blade being mounted on said support block through said leaf spring.

3. A yarn cutting scissors device as defined in claim 1, wherein said spacer means comprises a shim washer interposedly arranged between said stationary blade and said support block.

4. A yarn cutting scissors device as defined in claim 2, wherein said spacer means comprises a shim washer interposedly arranged between said leaf spring and said support block.

5. A yarn cutting scissors device as defined in claim 1, wherein said bias means comprises a spring.

6. A yarn cutting scissors device as defined in claim 5, said spring comprises a compression coil spring fitted on said oscillating shaft so as to be interposed between said oscillating shaft and said support block.

7. A yarn cutting scissors device as defined in any one of claims 1 to 6, wherein said movable blade includes a blade body comprising a blade plate and a cutting edge perpendicular to said blade plate, said blade body being formed to have a small thickness.

8. A yarn cutting scissors device comprising:

a support block having a horizontal through-hole;

an oscillating shaft supportedly inserted through said through-hole of said support block so as to be oscillated in the circumferential direction thereof;

a stationary blade fixedly mounted on a front end surface of said support block;

a movable blade fixedly mounted on a front end of said oscillating shaft so as to be opposite to said stationary blade and arranged to carry out the accessible movement with respect to said stationary blade with the oscillation of said oscillating shaft;

a leaf spring having one end fixedly mounted on said front end surface of said support block and the other end on which said stationary blade is mounted, said stationary blade being mounted on said front end surface of said support block through said other end of said leaf spring;

a spacer interposedly arranged between said front end surface of said support block and said leaf spring to define a gap therebetween which is sufficient to cause said leaf spring to be oscillated therethrough about said spacer in the longitudinal direction of said oscillating shaft; and spring means mounted on a rear portion of said support block to constantly urge said oscillating shaft in the rearward direction, and thereby force said movable blade against said stationary blade.

* * * * *